US008081122B2

(12) United States Patent
Kearney et al.

(10) Patent No.: US 8,081,122 B2
(45) Date of Patent: Dec. 20, 2011

(54) FOLDED SLOTTED MONOPOLE ANTENNA

(75) Inventors: David Kearney, Dublin (IE); Joseph Modro, Dublin (IE)

(73) Assignee: TDK Corporation, Tokyo (JP)

( * ) Notice: Subject to any disclaimer, the term of this patent is extended or adjusted under 35 U.S.C. 154(b) by 262 days.

(21) Appl. No.: 12/457,434

(22) Filed: Jun. 10, 2009

(65) Prior Publication Data

US 2010/0315303 A1 Dec. 16, 2010

(51) Int. Cl.
*H01Q 9/04* (2006.01)

(52) U.S. Cl. ..... 343/700 MS; 343/702

(58) Field of Classification Search ..... 343/700 MS, 343/702

See application file for complete search history.

(56) References Cited

U.S. PATENT DOCUMENTS

| | | | | |
|---|---|---|---|---|
| 5,828,340 | A | 10/1998 | Johnson | |
| 7,268,731 | B2 | 9/2007 | Chiang et al. | |
| 2006/0227051 | A1 * | 10/2006 | Yamamoto et al. | 343/700 MS |
| 2007/0273604 | A1 | 11/2007 | Wong et al. | |

FOREIGN PATENT DOCUMENTS

| | | | |
|---|---|---|---|
| EP | 1 986 270 | A1 | 10/2008 |
| KR | 2003021069 | A * | 3/2003 |

* cited by examiner

*Primary Examiner* — Dieu H Duong
(74) *Attorney, Agent, or Firm* — Oliff & Berridge, PLC

(57) ABSTRACT

A slotted monopole wideband antenna, comprising an insulating rectangular chip mounted on a carrier substrate, said carrier substrate including a feeding structure, and said chip comprising a first side adjacent to said feeding structure, a feed point of the antenna is located near said first side. An electrically conducting lamina is folded over four faces of said insulating chip, said lamina being connected to the feed point at one end, and to ground at another end. At least two slots are formed in an upper section of said folded lamina, said slots having the effect of lowering the principal resonance of said antenna, thereby providing a miniaturized antenna suitable for integration in a mobile wireless communications handset.

19 Claims, 12 Drawing Sheets

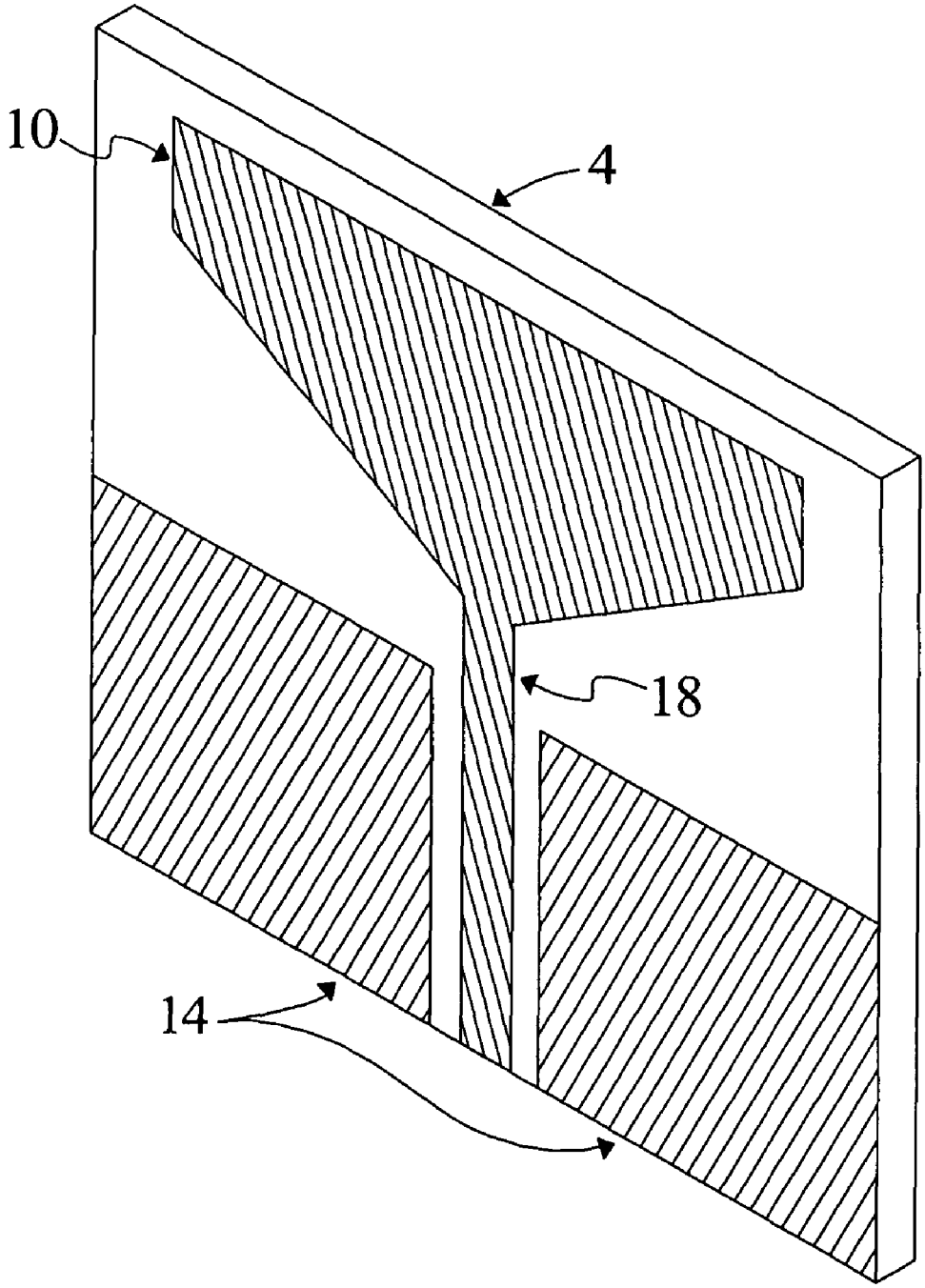
Fig. 1 - PRIOR ART

FOLDED SLOTTED MONOPOLE ANTENNA

TECHNICAL FIELD TO WHICH THE INVENTION BELONGS

The present invention relates to the field of antennas for portable wireless applications, in particular antennas for Ultra-Wideband applications, monopole antennas, chip antennas, block antennas.

BACKGROUND OF THE INVENTION

With the wireless communication industry continually expanding, there is more and more demand for antenna solutions which provide a combination of high performance, low cost and small size to support the increasing number of wireless protocols. As multiple antennas are integrated into portable wireless handsets to provide wide ranging functionality (including Bluetooth, WiFi, GPS, UWB etc.), size in particular has become a critical factor.

The Federal Communications Commission (FCC) has approved the operation of UWB systems in the 3.2-10.6 GHz band. The UWB system defines a means for short-range high data-rate wireless transmission between electronic devices using a stream of very narrow or short duration RF pulses. The short pulses produce a UWB data stream which occupies a wide band in the RF spectrum. However, the radiated power level of a UWB data stream is lower than the sensitivity of most narrow band electronic devices; hence, UWB devices do not interfere with other electronic devices operating over a narrow band even though the operating band may be inside the frequency range of the UWB data stream.

UWB systems are best suited to short-range, indoor applications such as Wireless Personal Area Networks (WPANs) in homes and offices. Since UWB has a far greater bandwidth than existing technologies, such as bluetooth and 802.11, high data-rate UWB has the potential to allow a whole new level of wireless connectivity. It enables the efficient transfer of data from digital imaging devices, wireless connection of printers and other peripherals to personal computers, and the high-speed transfer of files between portable devices such as wireless handsets & MP3 players It also allows the wireless connection of DVD players, BluRay™ players etc. to TV sets. Thus, a wireless home or office becomes a reality, where the cable clutter and lack of mobility that is traditionally associated with the connection together of numerous electronic devices is eliminated.

The wide operating band of a UWB device produces a number of design challenges for the electronics engineer. One such challenge is in the design of a suitable antenna. A typical UWB antenna is required to provide a similar performance level to a narrow band antenna except the performance must be maintained over a much wider frequency range.

For example, when integrated in a portable wireless handset, an antenna will typically have ground planes located near the active radiating elements. Such closely located ground planes cause the fields around the antenna to be pulled in towards the ground plane. The effect of bringing a ground plane near the active radiating elements of an antenna is to greatly reduce the band width of the antenna.

One approach to provide a broadband antenna suitable for UWB devices is taught in United States Patent US005828340A "Wideband Sub-wavelength Antenna", J. Michael Johnson. The antenna taught by Johnson is shown in FIG. 1 and comprises a tapered monopole patch radiating element 10 which is printed on a dielectric substrate 4 and which extends from a ground plane 14 located adjacent to the feed point 18 of the antenna and provides good electrical characteristics over a wide operating band. However, the antenna taught by Johnson has the disadvantage of having a relatively large physical size and the further disadvantage that any ground plane brought close to either side of the antenna will cause deterioration in performance. One way to reduce the size of the antenna is to fold it back in on itself as taught in European Patent application EP1986270A1 "Antenna Device and Communication Apparatus Employing Same", Kuramoto, which teaches a similar antenna to that of FIG. 1 except where the radiating element is folded so that the open circuit end is in line with the feed point of the antenna. Folding the antenna as taught by Kuramoto reduces the overall size of the antenna.

SUMMARY OF THE INVENTION

Accordingly, the invention provides an antenna comprising an electrically insulating carrier substrate having a first surface and a second surface; a first ground plane partially covering at least one of said first or second surfaces of said carrier substrate; an electrically insulating block mounted on said first surface of said carrier substrate so that a first end of said insulating block is located near said first ground plane, said insulating block having a first face facing said first surface of said carrier substrate, and an opposite second face facing away from said first surface of said carrier substrate; a feed line provided on one of said first or second surfaces of said carrier substrate; a feed point located near said first end of said insulating block; a first electrically conductive lamina section located on said first face of said insulating block; and a second electrically conductive lamina section located on said second face of said insulating block, wherein said first and second lamina sections are electrically connected together at a second end of said insulating block, said second end being substantially opposite said first end of said insulating block, wherein said second lamina section is shaped to define at least two slots, said at least two slots extending from opposite sides of said second electrically conductive lamina section and being interleaved so as to define a non-linear current path in said second lamina section between said first and second ends of said insulating block, and wherein an end of said second lamina section that is adjacent to said first end of said insulating block is electrically connected to said first ground plane.

Preferred embodiments of the invention provide an antenna which operates in the UWB Band Group 1 range (3.2-4.8 GHz) and which is suitable for integration into portable wireless handsets.

In preferred embodiments, the antenna is a monopole antenna comprising an electrically insulating preferably ceramic block and further comprises a metallic lamina which is folded over the electrically insulating, preferably ceramic block. RF signals (including microwave signals) are fed to and from the antenna via the feed point of the antenna. The antenna is grounded by two grounding strips located at the same side of the insulating block as the feed point. In typical other prior art antennas, this would correspond to the open circuit end of the antenna.

Preferably, the antenna is capable of being integrated into a portable wireless handset.

Preferably, antennas embodying the present invention are capable of transmitting and receiving electrical signals according to Ultra-Wideband (UWB) wireless protocol and facilitate high speed transfer of data between the handset and other portable devices.

Preferably, the slots which are formed in the second lamina section are located in such a way that each consecutive slot is cut from an opposite side of the second lamina section.

Preferably, the slots are tapered at their ends to facilitate smooth current flow though the antenna structure.

Forming slots in the second lamina section has the effect of reducing the centre frequency of the main resonance of the antenna. This reduction in frequency is caused by the fact that the slots increase the length of the current path from the feed point to ground, which produces an increase in the effective dimensions of the antenna. The effect of forming slots in the second lamina section is to provide an antenna which has a lower operating band while still maintaining its small size.

The performance of antennas embodying the present invention is thus improved compared with prior art monopole antennas which are grounded at what would normally be the open circuit (high E-field) end of the antenna.

The preferred combination of the formation of slots in the antenna pattern, the folding of the antenna sections around an insulating block, the grounding strips and the close proximity of the ground plane to the antenna reduces the overall size of the antenna compared to prior art monopole antennas designed for wideband operation. The overall 'envelope volume' (where the envelope volume is the total space required by the antenna within which no other components or metal objects can be placed) of the antenna is also reduced. For these reasons, the antenna of the present invention is highly suitable for integration in a portable wireless handset where high performance and small size are typical requirements.

In typical embodiments, mounting pads will be included on the obverse face of the carrier substrate. When the antenna is mounted on the carrier substrate, the mounting pads are positioned underneath the insulating block, near the feed point. Typically, the antenna is attached to the carrier substrate by soldering, where solder is applied to the mounting pads. This configuration ensures that the antenna is attached to the carrier substrate in a mechanically robust manner. In typical embodiments, a keep-out area surrounds the antenna on the carrier substrate in which no other components are placed, either on an obverse surface or on a reverse surface of the carrier substrate.

Preferably, the antenna of the present invention is mounted near a corner of the printed wiring board of a portable wireless handset—with typical dimensions of 80 mm×40 mm. The printed wiring board of a portable wireless handset typically comprises an insulating substrate with a dielectric constant greater than unity—for example, FR4, and a ground plane on one or more surfaces thereof. In cases where the ground plane is fabricated on both surfaces of the printed wiring board, electrical connection between the pair of ground planes is facilitated by means of a number of metal lined or metal filled cylindrical through holes or vias which penetrate the insulating substrate.

Further advantageous aspects of the invention will become apparent to those ordinarily skilled in the art upon review of the following description of preferred embodiments and with reference to the accompanying drawings.

BRIEF DESCRIPTION OF THE DRAWINGS

Embodiments of the invention are now described by way of example and with reference to the accompanying drawings in which like numerals are used to indicate like parts and in which:

FIG. 1 shows a prior art wideband sub-wavelength antenna, the antenna being a tapered monopole antenna which is printed on a dielectric substrate and which extends from a ground plane at the feed end.

DETAILED DESCRIPTION OF THE DRAWINGS

First Embodiment

Figure 2A:
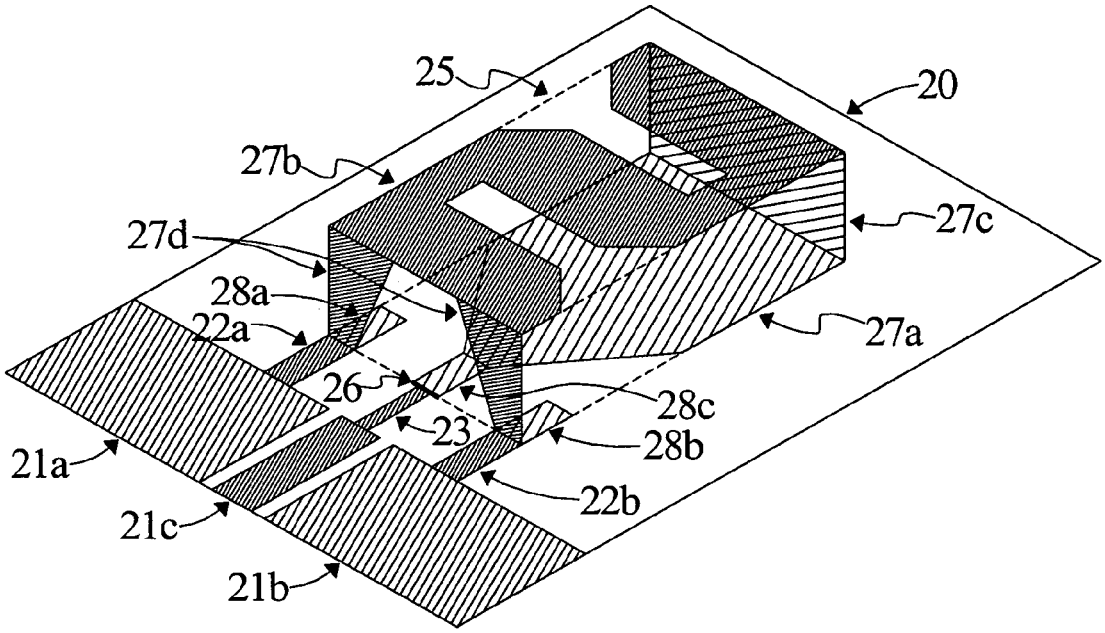
FIG. 2A shows a folded slotted monopole antenna according to a first embodiment of the present invention.

FIG. 2A shows a folded slotted monopole antenna according to a first embodiment of the present invention. The antenna of FIG. 2A comprises an electrically insulating block 25, where the material of the block has a dielectric constant greater than unity. The insulating block 25 is mounted on a carrier substrate 20. The insulating block 25 is preferably rectangular in shape and is preferably of a ceramic material. The carrier substrate 20 includes an electrically conductive, typically metallic feed-line 21*c* and ground planes 21*a*, 21*b* formed on an obverse surface thereof. Preferably the ground planes 21*a*, 21*b* are formed on either sides of feed line 21*c*, so that the combined structure forms a co-planar waveguide. The insulating block 25 is mounted on the carrier substrate 20 so that a first end thereof is nearest the feed-line 21*c* and the pair of ground planes 21*a*, 21*b*. The insulating block 25 comprises lower and upper horizontal faces (as viewed in the drawings) which are substantially parallel to the carrier substrate 20, and four vertical (as viewed in the drawings) faces which are substantially perpendicular to the carrier substrate 20 and where there are preferably a pair of identically sized larger vertical faces and a pair of identically sized smaller vertical faces.

A feed point 26 is located near the first end of the insulating block 25. Preferably, the feed point 26 is adjacent to the carrier substrate 20 and is located on an edge of one of the pair of smaller vertical faces of the insulating block 25. The feed point 26 passes RF signals (including microwave signals) from a transceiver device (not shown) to the antenna and similarly passes RF signals (including microwave signals) received by the antenna to a transceiver device.

The antenna of FIG. 2A further comprises an electrically conductive, typically metallic lamina which is folded around four of the faces of the insulating block 25. Preferably the folded metallic lamina is formed by a process of printing metallic patterns on the four faces of the insulating block 25. The folded metallic lamina comprises a first planar metallic section 27*a*, which is printed on the lower horizontal face of the insulating block (adjacent to the carrier substrate), a second planar metallic section 27*b* which is printed on the upper horizontal face of the block (opposite the carrier substrate), a third planar metallic section 27*c* which electrically connects the first and second planar metallic sections and which is printed on the vertical face of the block opposite the first end of the insulating block, and fourth planar metallic section 27*d*, which is printed on the vertical face at the first end of the insulating block.

In alternative embodiments (not illustrated), the third planar section 27*c* need not necessarily cover the whole face of the block 25, and may be replaced by one or more electrically conductive strips or vias.

The fourth planar metallic section 27*d* comprises a pair of metallic strips which connect the second planar metallic section to respective ground terminals 28*a*, 28*b* which are formed on the lower horizontal face of the insulating block 25. In alternative embodiments (not illustrated), the strips of section 27*d* may be replaced by a respective electrically conductive via.

Ground pads 24*a*, 24*b* are formed on the obverse face of the carrier substrate (shown in FIG. 2B) and lie in register with the ground terminals 28*a*, 28*b* printed on the lower horizontal face of the insulating block 25. The pair of metallic strips of the fourth planar metallic section 27*d* are preferably tapered so that they are narrower where they connect to the ground terminals 28*a*, 28*b* and wider where they connect to the second planar metallic section 27*b*. The purpose of tapering the pair of metallic strips in this way is to minimize electrical discontinuities which might occur at the interface between the fourth planar metallic section 27*d* and the second planar metallic section 27*b*.

The ground pads 24*a*, 24*b* are respectively connected to the ground planes 21*a*, 21*b* via two ground connecting strips 22*a*, 22*b* also formed on the obverse surface of the carrier substrate which extend from the ground pads 24*a*, 24*b* to the respective edges of the ground planes 21*a*, 21*b* nearest the first end of the insulating block 25.

A feed pad 24*c* is formed on the obverse face of the carrier substrate and between the ground pads 24*a* and 24*b*. A corresponding feed terminal 28*c* is formed on the lower face of the insulating block and lies in register with the feed pad 24*c*.

The feed terminal 28*c*, is connected to the first planar metallic section 27*a*, and passes signals from the feed point 26 to the antenna, and vice versa.

The feed pad 24*c* is connected to the feed line 21*c* via a feed connecting strip 23 formed on the obverse surface of the carrier substrate which extends from the feed pad 24*c* to the edge of the feed line 21*c*. Preferably, the feed connecting strip 23 is narrower than the feed line 21*c* so as to provide inductive loading at the antenna feed point 26.

The feed line 21*c* of the antenna of FIG. 2A is bounded on both sides by ground planes 21*a*, 21*b* so that the feeding structure forms a coplanar waveguide. However, suitable alternative arrangements to the feeding structure of FIG. 2A would include a microstrip feed comprising a feed line suspended over a ground plane, a grounded coplanar waveguide or any other structure suitable for passing RF signals (including microwave signals) to and from the feed point of the antenna.

The first planar metallic section 27*a* of the folded metallic lamina of FIG. 2A tapers out from the feed terminal 28*c* and increases in width so that it has the same width as the insulating block 25 approximately midway between the feed point 26 and the third planar metallic section 27*c*. Tapering of the first planar metallic section 27*a* in this way helps reduce discontinuities and current 'bunching' in the corners of the first planar metallic section and improves the overall impedance bandwidth of the antenna.

The second planar metallic section 27*b* can be described as comprising a rectangular metallic pattern which covers the upper face of the insulating block, and which further comprises at least two slots which are cut into the rectangular metallic pattern, where the slots are cut from the two sides of the rectangle which are perpendicular to the first end of the insulating block 25 and where successive slots are cut from opposite sides of the rectangular metallic pattern. The slots are preferably tapered towards the sides of planar metallic section 27*b* to facilitate smooth current flow though the antenna. The slots overlap with one another in a direction that is perpendicular to the direction in which they extend. Hence, the slots create a meandering path for current flowing in the metallic section 27*b*.

Forming slots in the sides of the second planar metallic section 27*b*, has the effect of reducing the centre frequency of the main resonance of the antenna. This provides an antenna which has a lower operating band while still maintaining its small size. The main current path of the antenna begins at the feed point 26, flows along the first planar metallic section 27*a*, up the vertical third planar metallic section 27*c* and back towards the feed point 26 along the second planar metallic section 27*b*, and to ground via the pair of metallic strips of the fourth metallic section 27*d*. The slots formed in the second planar metallic section force the current to take a longer route from the feed point 26 to the pair of metallic strips of the fourth metallic section 27*d* and thus increases the overall current path within the antenna.

The grounding of the antenna by means of the pair of ground strips of the fourth metallic section 27*d* reactively loads the antenna at what would normally be the open circuit (or high E-field) end of the folded monopole antenna. In general, reactive loading of an antenna involves adding capacitance or inductance to tune the impedance bandwidth of the antenna as desired. In this case, reactive loading pulls the main quarter wavelength resonance of the antenna down in frequency providing a lower frequency of operation of the antenna while still maintaining the small size of the antenna structure. The grounding of the antenna at the open circuit end also reduces the Q of the antenna which greatly improves its operating bandwidth. Thus, the antenna of the present invention maintains a low profile and a small size while achieving good performance across the UWB band group 1 band.

The pair of metallic strips of the fourth metallic section 27*d* also provides the advantage of re-directing the electric fields of the antenna away from the carrier substrate and away from the antenna structure itself, allowing the antenna to radiate more efficiently.

The combination of the formation of slots in the second planar metallic section 27*b*, and the folding the antenna sections around an insulating block 25 as described herein and as depicted in FIG. 2A reduces the overall size of the antenna compared to prior art monopole antennas designed for wideband operation. For this reason, the antenna of the present invention is highly suitable for integration in a portable wireless handset, where high performance and small size are typical requirements.

Preferably, the first 27*a*, second 27*b*, third 27*c* and fourth 27*d* planar metallic sections of the antenna of FIG. 2A are printed with a conductive material such as aluminum paste.

The insulating block 25 of the antenna of the first embodiment of the present invention may be formed of a ceramic material or some other electrically insulating material where the material of the block is chosen for its electrical and magnetic characteristics at the frequency of interest.

Figure 2B:
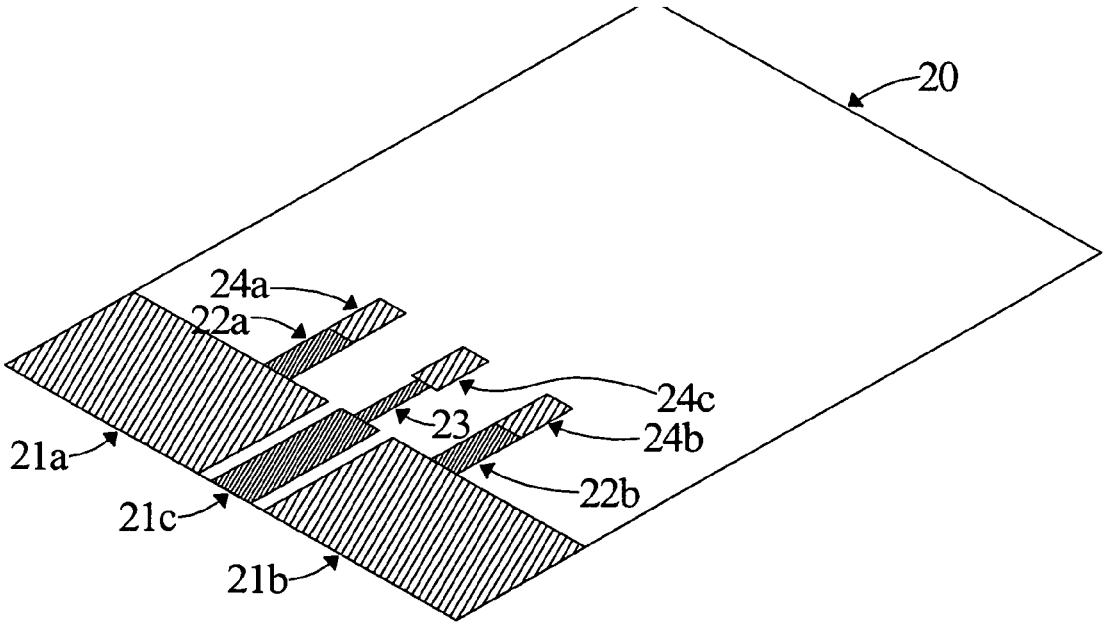
FIG. 2B shows the carrier substrate of the antenna of FIG. 2A absent the insulating block the feed point and the folded lamina.

FIG. 2B shows the carrier substrate 20 of the antenna of FIG. 2A without the insulating block 25, the feed point 26 and the folded lamina, and reveals the ground pads 24*a*, 24*b* and the feed pad 24*c* which are concealed by the ground terminals 28*a*, 28*b* and the feed terminal 28*c* in FIG. 2A.

Figure 3:
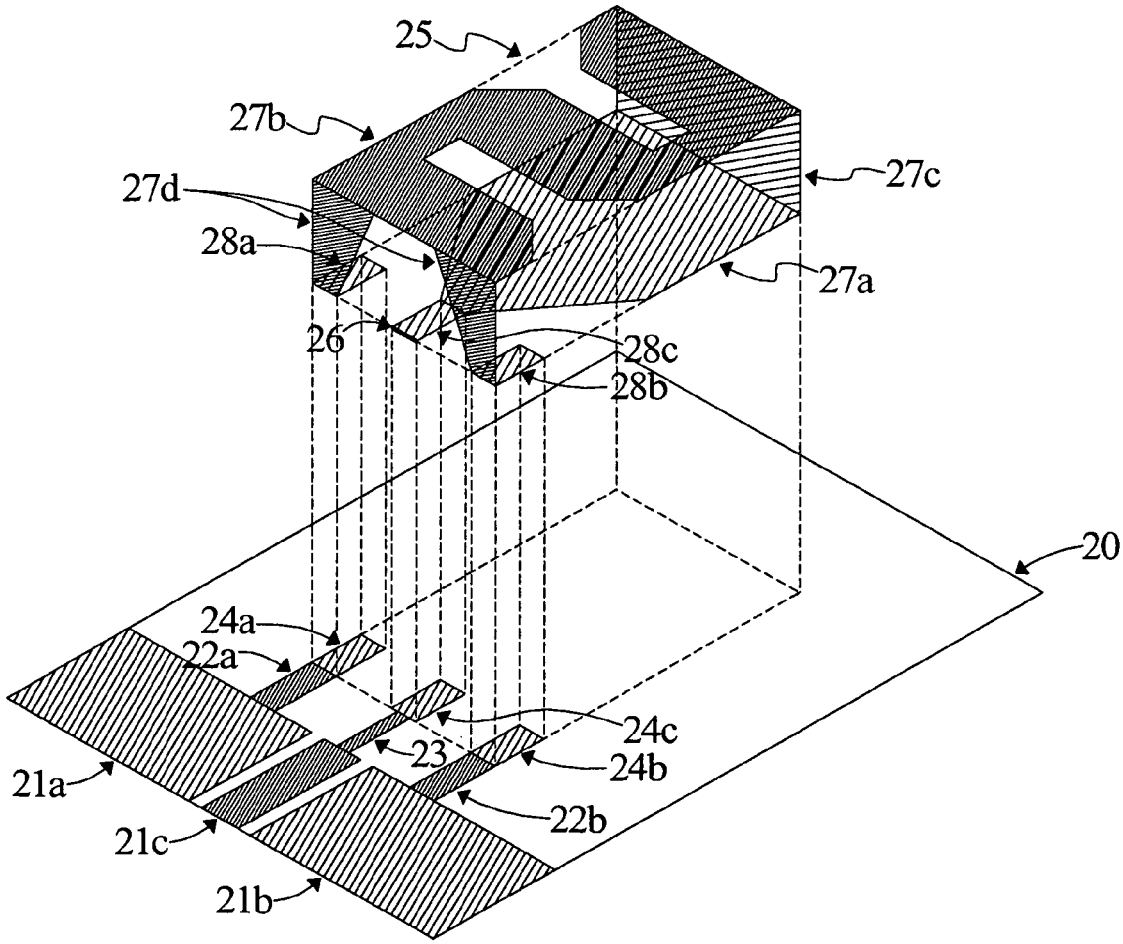
FIG. 3 shows the carrier substrate of the antenna of FIG. 2A where the insulating block, the feed point and the folded lamina have been elevated relative to the carrier substrate.

FIG. 3 shows the carrier substrate 20 of the antenna of FIG. 2A where the insulating block 25, the feed point and the folded lamina have been elevated relative to the carrier substrate 20 in order to show the alignment of the ground pads 24*a*, 24*b*, the feed pad, 24*c* with the ground terminals 28*a*, 28*b*, and the feed terminal 28*c*.

Figure 4:
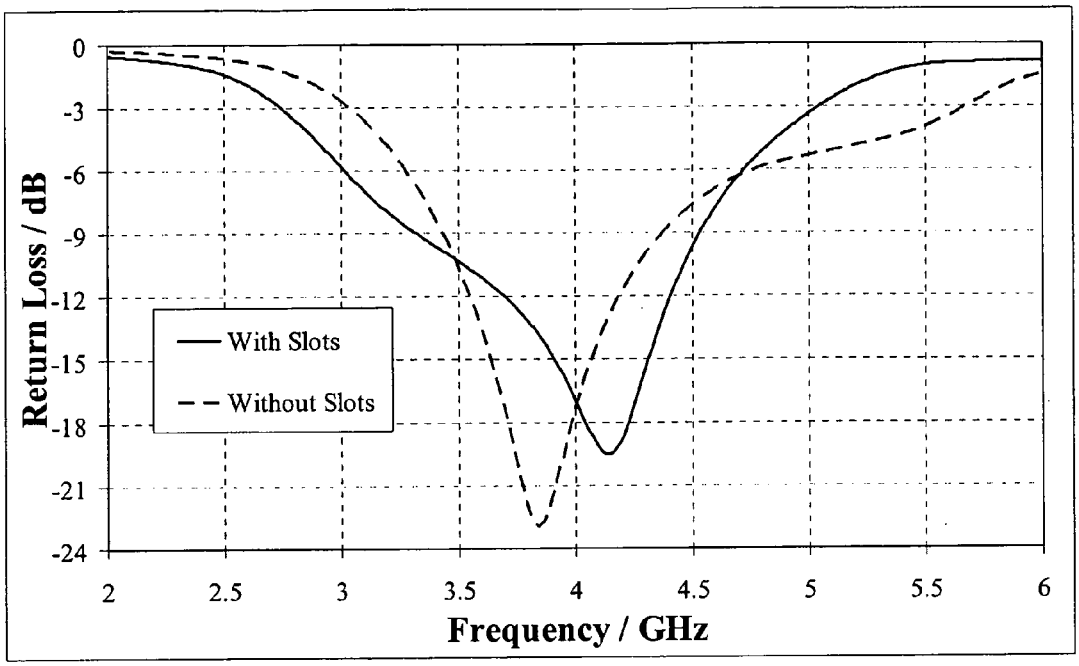
FIG. 4 shows a plot of return loss versus frequency for the antenna of FIG. 2A overlaid with a plot of return loss versus frequency for a similar antenna without slots, where the data for the plots were generated by electromagnetic simulation.
Figure 5:
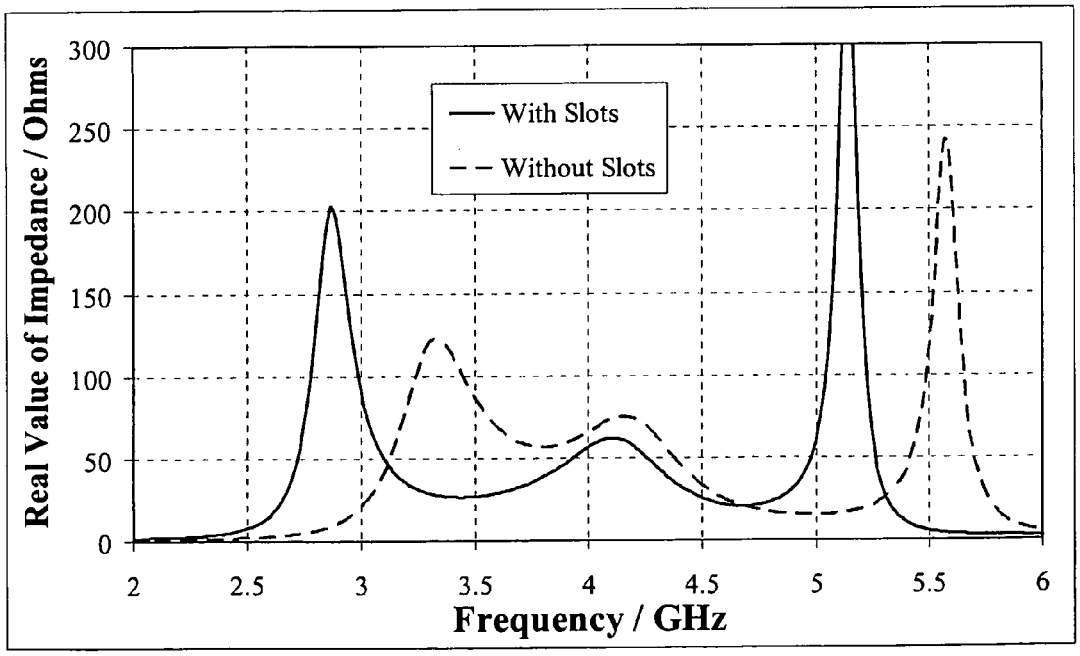
FIG. 5 shows a plot of the real value of the impedance versus frequency for the antenna of FIG. 2A overlaid with a plot of the real value of the impedance versus frequency for a similar antenna without slots, where the data for the plots were generated by electromagnetic simulation.

FIG. 4 shows the results of computer generated electromagnetic simulations of the antenna of the first embodiment of the present invention as shown in FIG. 2A and a similar antenna except without slots in the second planar section 27*b*. A ceramic block with a dielectric constant of 7.5 was used for this simulation and all other simulations. For comparison of the performances of the two antennas, plots of return loss (dB) versus frequency (GHz) are overlaid. FIG. 5 shows a comparison of the performance of the antennas where the simulated real values of the input impedances of the antennas (Ohms) vs. frequency (GHz) are overlaid.

Figure 6:
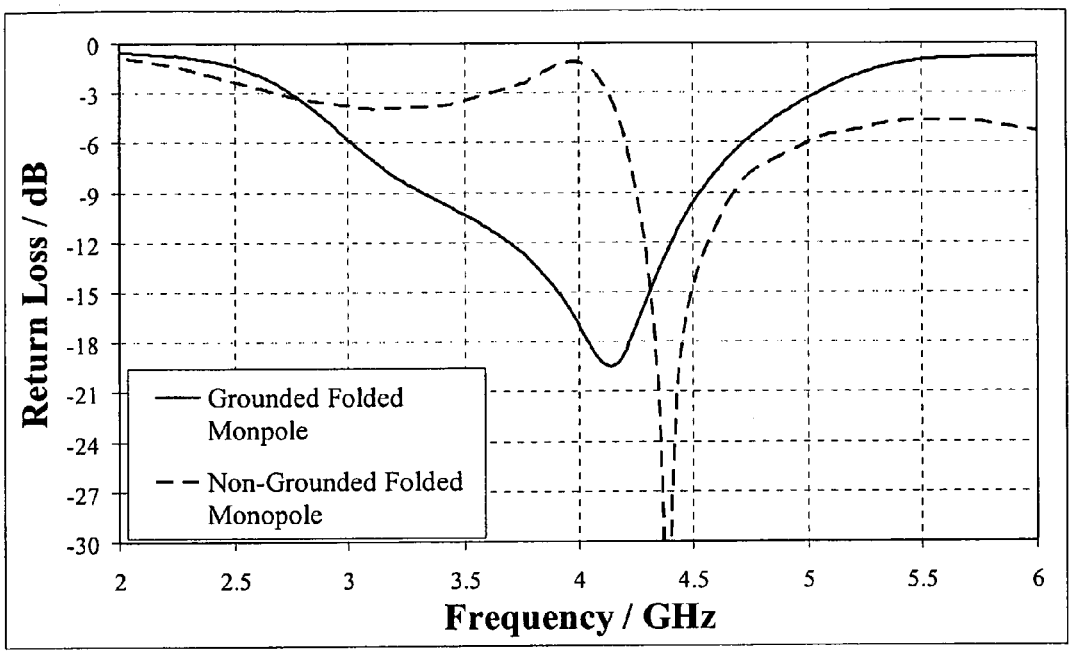
FIG. 6 shows the results of an electromagnetic simulation of the return loss versus frequency for the antenna of FIG. 2A plotted on a graph and overlaid with a similar plot for a similar antenna without slots and without grounding strips near its feed point.
Figure 7:
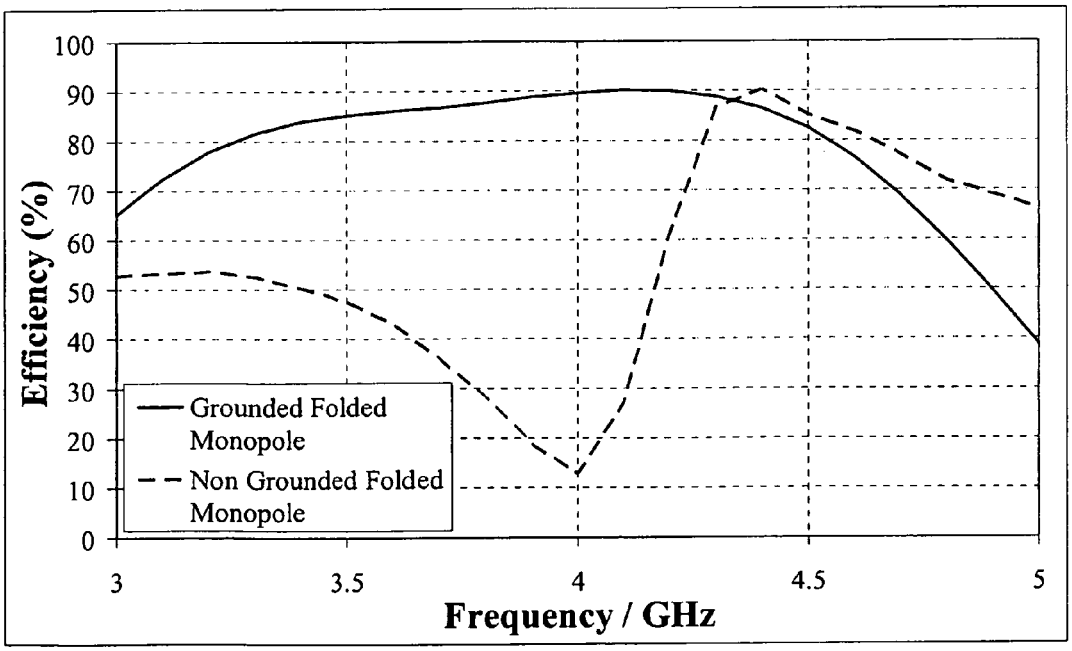
FIG. 7 shows the results of an electromagnetic simulation of the efficiency of the antenna of FIG. 2A plotted on a graph and overlaid with a similar plot for a similar antenna without slots and without grounding strips near its feed point.

FIG. 6 shows the results of computer generated electromagnetic simulations of the antenna of the first embodiment of the present invention as shown in FIG. 2A and a similar antenna except without slots in the second planar section 27*b* and without fourth planar metallic section 27*d*. For comparison of the performances of the two antennas, plots of return loss (dB) versus frequency (GHz) are overlaid. FIG. 7 shows a comparison of the performance of the antennas where the simulated efficiencies of the antennas (%) vs. frequency (GHz) are overlaid.

It is clear from the plots of FIG. 4, FIG. 5, FIG. 6 and FIG. 7 that the overall efficiency of the antenna of the present invention is much better than the similar antennas without slots or without grounding.

Figure 8:
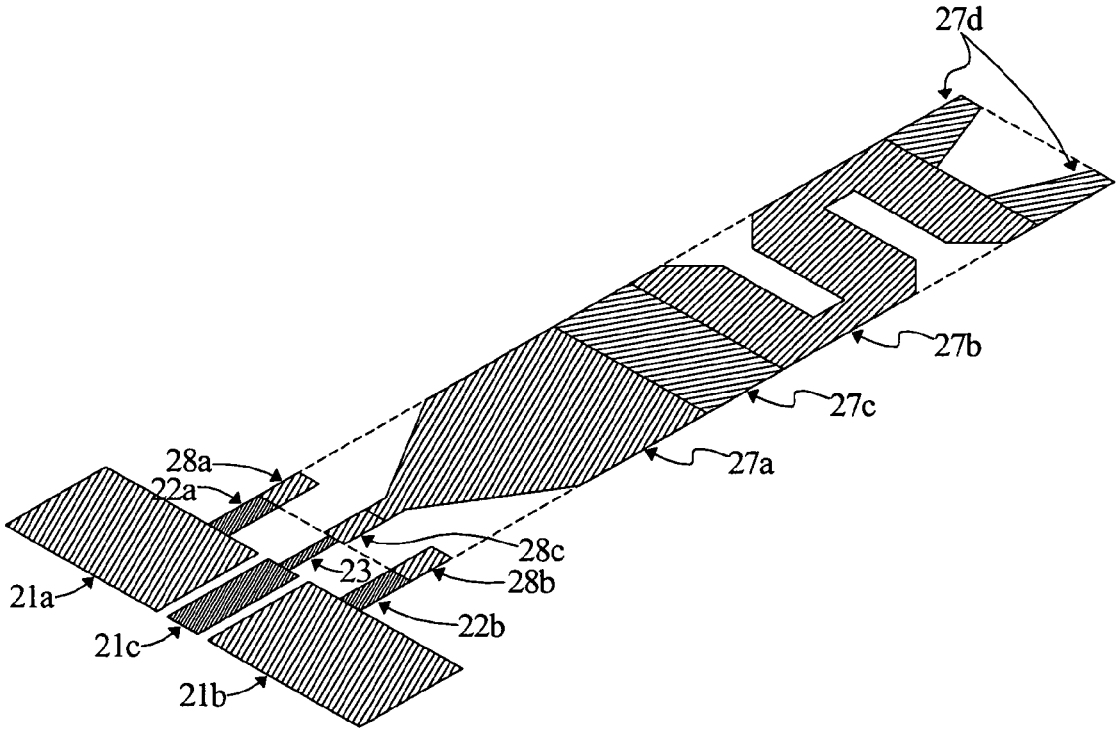
FIG. 8 shows a drawing of the metallic sections of the antenna of FIG. 2A (including carrier substrate) where the metallic lamina has been unfolded so as to show its construction.

FIG. 8 shows a drawing of the metallic sections of the antenna of FIG. 2A, including the carrier substrate 20 where the metallic lamina has been unfolded so as to illustrate the shape and construction of the folded lamina, and to show the form of the first planar metallic section 27*a*, the second planar metallic section 27*b*, the third planar metallic section 27*c* and the fourth planar metallic section 27*d*.

Second Embodiment

Figure 9A:
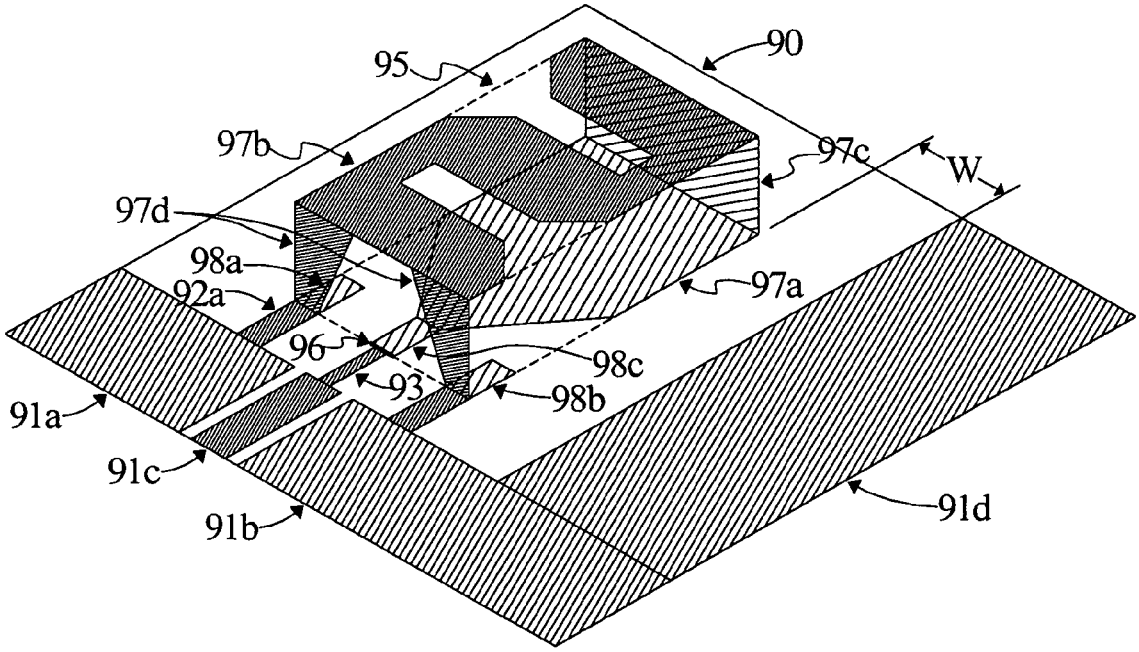
FIG. 9A shows a folded slotted monopole antenna according to a second embodiment of the present invention with a ground plane adjacent to one side of the insulating block and with a gap W between the ground plane and the insulating block.

FIG. 9A shows a folded slotted monopole antenna according to a second embodiment of the present invention. With the exception of the ground plane as described hereinafter, the antenna of FIG. 9A may be substantially the same as the antenna of FIG. 2A and so similar descriptions apply.

The antenna of FIG. 9A comprises an insulating block 95, where the material of the block has a dielectric constant greater than unity. The insulating block 95 is mounted on a carrier substrate 90, is preferably rectangular in shape and is preferably of a ceramic material. The insulating block 95 comprises lower and upper horizontal faces which are substantially parallel to the carrier substrate 90, and four vertical faces which are substantially perpendicular to the carrier substrate 90 and where there are preferably a pair of identically sized larger vertical faces and a pair of identically sized smaller vertical faces. The carrier substrate includes a metallic feed-line 91*c* and ground planes 91*a*, 91*b* and 91*d* formed on an obverse surface thereof. The insulating block 95 is mounted on the carrier substrate so that a first end thereof is nearest the feed-line 91*c* and the ground planes 91*a* and 91*b*. Ground plane 91*d* protrudes from ground plane 91*b* and extends along a side of the insulating block 95 so that a vertical face thereof—preferably one of the pair of larger vertical faces—is adjacent to but spaced-apart from ground plane 91*d*.

A feed point 96 is located near the first end of the insulating block 95. Preferably, the feed point 96 is adjacent to the carrier substrate 90 and is located on an edge of one of the pair of smaller vertical faces of the insulating block 95. The feed point 96 passes RF signals (including microwave signals) from a transceiver device (not shown) to the antenna and similarly passes RF signals (including microwave signals) received by the antenna to a transceiver device.

The antenna of FIG. 9A further comprises a metallic lamina which is folded around four of the faces of the insulating block 95. Preferably the folded metallic lamina is formed by a process of printing metallic patterns on the four faces of the insulating block 95. The folded metallic lamina comprises a first planar metallic section 97*a*, which is printed on the lower horizontal face of the insulating block (adjacent to the carrier substrate), a second planar metallic section 97*b* which is printed on the upper horizontal face of the block (opposite the carrier substrate), a third planar metallic section 97*c* which electrically connects the first and second planar metallic sections and which is printed on the vertical face of the block opposite the first end of the insulating block 95, and a fourth planar metallic section 97*d*, which is printed on the vertical face at the first end of the insulating block.

The fourth planar metallic section 97*d* comprises a pair of metallic strips which connect the second planar metallic section to respective ground terminals 98*a*, 98*b* which are formed on the lower horizontal face of the insulating block 95. A corresponding pair of ground pads are formed on the obverse face of the carrier substrate (not shown) and lie in register with the ground terminals 98*a*, 98*b* printed on the lower horizontal face of the insulating block 95. The pair of metallic strips are tapered so that they are narrower where they connect to the ground terminals 98*a*, 98*b* and wider where they connect to the second planar metallic section 97*b*.

The ground pads are respectively connected to the ground planes 91*a*, 91*b* via two ground connecting strips 92*a*, 92*b* also formed on the obverse surface of the carrier substrate.

A feed terminal 98*c* is formed on the lower face of the insulating block and lies in register with a corresponding feed pad which is formed on the obverse face of the carrier substrate (not shown).

The feed terminal 98*c*, is connected to the first planar metallic section 97*a*, and passes signals from the feed point 96 to the antenna, and vice versa.

The feed pad is connected to the feed line 91*c* via a feed connecting strip 93 formed on the obverse surface of the carrier substrate 90. Preferably, the feed connecting strip 93 is narrower than the feed line 91*c* so as to provide inductive loading at the antenna feed point 96.

The feed line 91*c* of the antenna of FIG. 9A is bounded on both sides by ground planes 91*a*, 91*b* so that the feeding structure forms a coplanar waveguide. However, suitable alternative arrangements to the feeding structure of FIG. 9A would be a microstrip feed comprising a feed line suspended over a ground plane, a grounded coplanar waveguide or any other structure suitable for passing RF signals (including microwave signals) to and from the feed point of the antenna.

The first planar metallic section 97*a* of the folded metallic lamina of FIG. 9A tapers out from the feed terminal 98*c* and increases in width so that it has the same width as the insulating block 95 approximately midway between the feed point 96 and the third planar metallic section 97*c*. Tapering of the first planar metallic section 97*a* in this way helps reduce discontinuities and current 'bunching' in the corners of the first planar metallic section and improves the overall impedance bandwidth of the antenna.

The second planar metallic section 97*b* can be described as comprising a rectangular metallic pattern which covers the upper face of the insulating block, and which further comprises at least two slots which cut into the rectangular pattern, where the slots are cut from the two sides of the rectangle which are perpendicular to the first end of the insulating block 95 and where successive slots are cut from opposite sides of the rectangular metallic pattern.

A feature of the antenna of FIG. 9A of the present invention is the gap W between the ground plane 91*d* and the nearest side of the insulating block 95. Typically, the performance of a monopole antenna is severely degraded if a ground plane is brought near more than one side of the radiating elements. On the contrary, for the current and like embodiments of the present invention, the performance is improved when there is a ground plane 91*d* brought near a side of the antenna, and moreover, there is an optimum size of the gap W between the ground plane 91*d* and the insulating block. In particular, the ground plane 91*d* is located adjacent a portion of the lamina in which a relatively large current flows during use. In preferred embodiments, the ground plane 91*d* is located adjacent an edge of the lamina section 97*a*. Advantageously, the edge of the lamina section 97*a* and the adjacent edge of the ground plane 91*d* are substantially parallel to one another.

Normally, when a ground plane is brought close to a side of a standard monopole antenna, such as that shown in FIG. 1, the close proximity of the ground plane to the radiating element of the antenna disrupts the electric field surrounding the antenna particularly at the open circuit or high e-field end of the antenna structure. Thus, radiation from the antenna is pulled towards the ground plane and energy which would normally be radiated is absorbed by the ground plane. This causes the directivity of the antenna to be altered and reduces the overall radiation efficiency of the antenna.

Another effect of locating a ground plane near a side of a monopole antenna is that the fundamental resonance of the antenna is pulled down in frequency. Loading of the antenna in this way tends to significantly degrade the match at the input of the antenna, and thus the bandwidth of operation of the antenna.

Since the antenna of the present invention is grounded at what would normally be its open circuit or high E-field end, it has some important advantages over a standard monopole antenna when a ground plane is brought near a side of the antenna.

Grounding the antenna in this way allows increased electromagnetic coupling to occur between the antenna and the ground plane 91*d*. This coupling causes a significant current to flow along the edge of the ground plane 91*d* closest to the antenna (as indicated by arrows Cg in FIG. 9B, from which it will be seen that the current Cg induced in the ground plane 91*d* flows in an opposite sense to the current Cl flowing in the lamina section 97*a*).

Due to the current flow, this edge portion of the ground plane 91*d* itself radiates and effectively becomes part of the antenna. This radiation combined with the radiation of the antenna structure means the overall power radiated is increased and thus the total effective efficiency of the antenna is increased.

The gap W between the ground plane 91*d* and the nearest side of the insulating block can be adjusted to provide optimum performance of the antenna. This is done by finding the value of W at which there is an optimum trade-off between the positive effect that the ground plane's close proximity has on the total efficiency of the antenna and the negative effect that this proximity has on the input match and bandwidth of operation of the antenna.

Figure 9B:
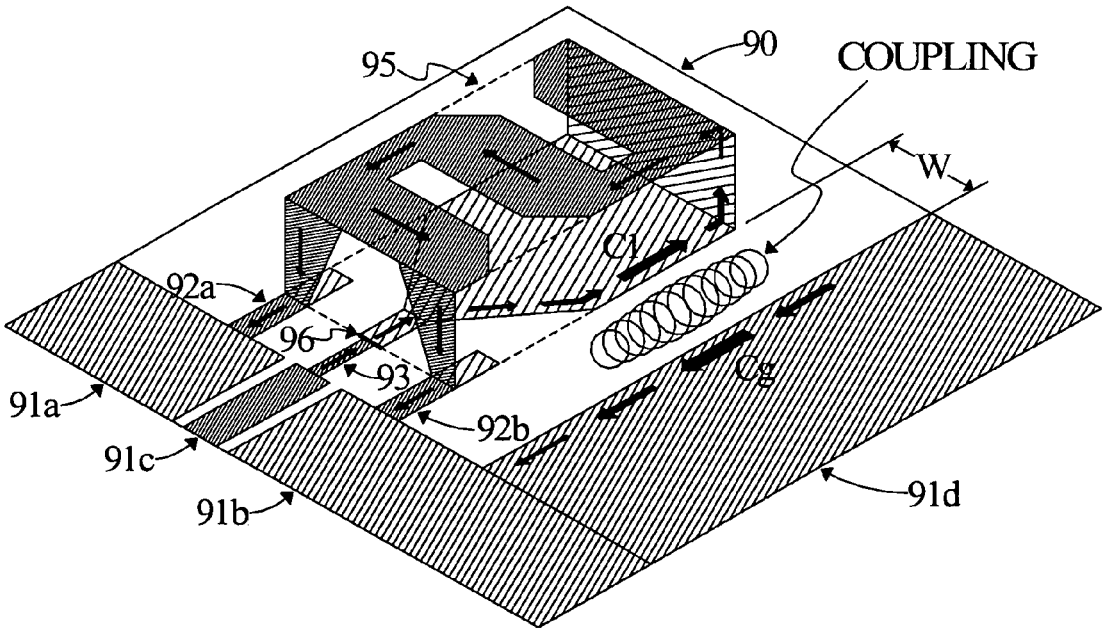
FIG. 9B shows the main current paths of the folded slotted monopole antenna of FIG. 9A.

FIG. 9B shoes the antenna of FIG. 9A and includes arrows that illustrate how the current paths within the antenna cause electromagnetic coupling between the antenna and the adjacent ground plane, and how this in turn induces a current along the adjacent ground plane which improves the overall performance of the antenna.

Figure 10:
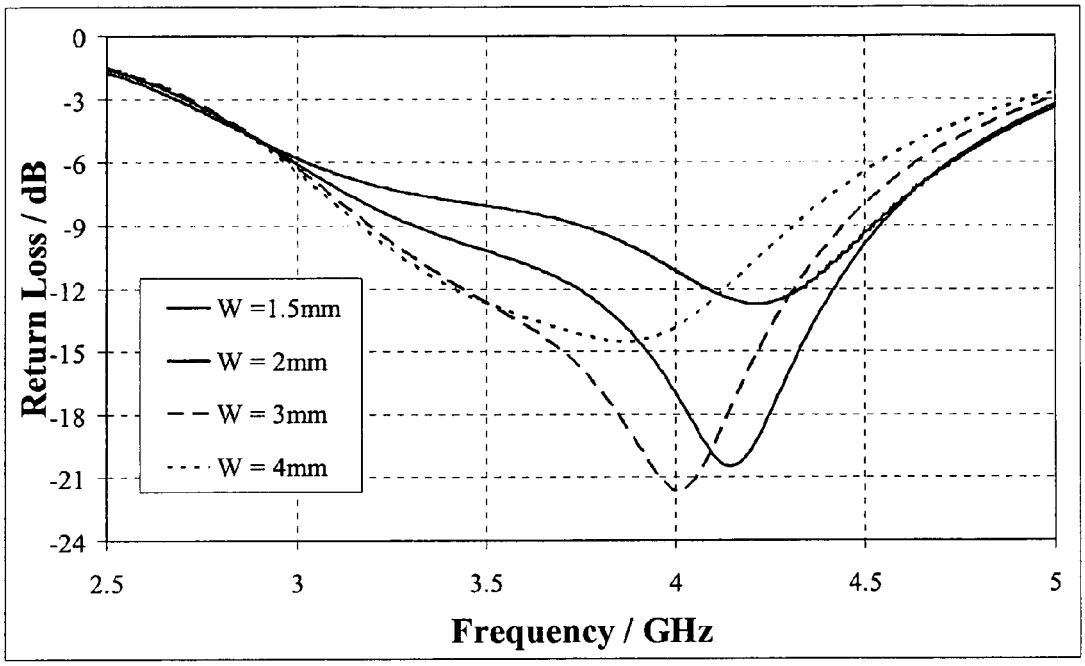
FIG. 10 shows respective plots on the same graph of return loss versus frequency for four sizes of the gap W of the antenna of FIG. 9A.

FIG. 10 shows plots of return loss versus frequency for various sizes of the gap W between the ground plane 91*d* and the nearest side of the insulating block 95 of the antenna of FIG. 9A. It can be seen from these plots that optimum performance of the antenna can be achieved across the 3.2-4.8 GHz frequency band when the size of the gap W is 2 mm.

Figure 11:
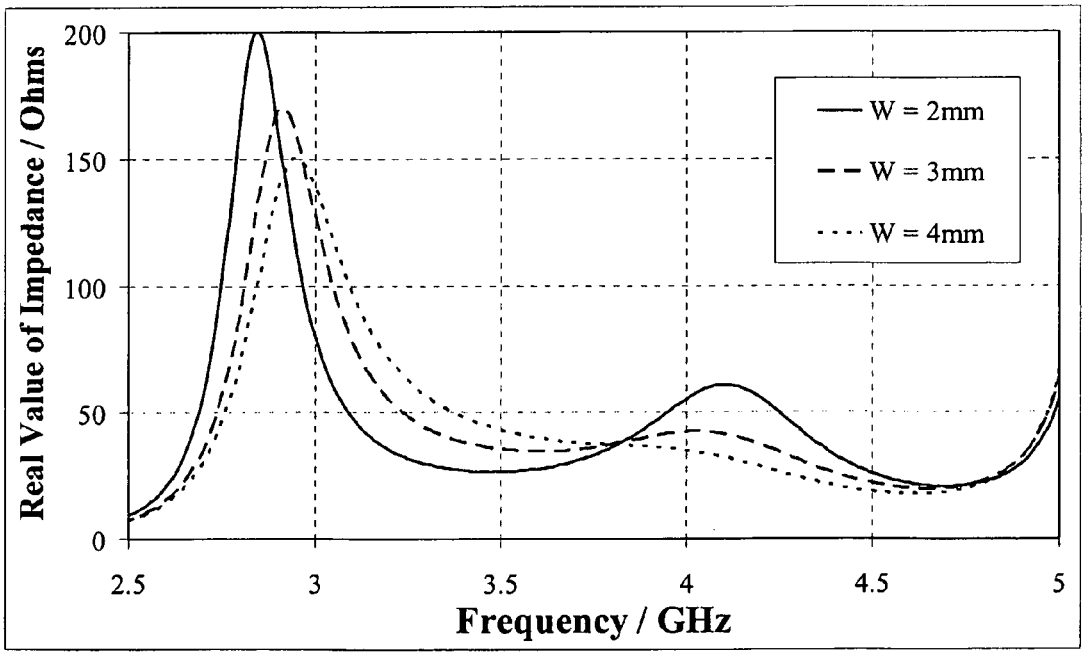
FIG. 11 shows respective plots of the real value of impedance versus frequency for three sizes of the gap W of the antenna of FIG. 9A.

FIG. 11 compares plots of the real value of the impedance of the antenna (Ohms) versus frequency (GHz) for various sizes of the gap W. As the ground plane 91*d* is brought nearer to the antenna, a secondary resonance occurs due to the coupling between the antenna and the ground plane. This resonance has a positive effect on the bandwidth of the antenna at the upper edge of the band. However, the main resonance becomes loaded by the ground plane and this disturbs the balance between the resonances and degrades the performance at the lower edge of the band. Thus, a balance must be found between this positive and negative effect, resulting in an optimum size for the gap W.

Increasing the height of the insulating block 25, 95 of the antenna of the first or second embodiments of the present invention increases the overall length of the current path through the antenna and thus allows the antenna to perform at a lower frequency. Also, increasing the height of the insulating block reduces the capacitance between the first planar metallic section 27*a*, 97*a* and the second planar metallic section 27*b*, 97*b*. This reduces the Q of the antenna thereby providing a broader bandwidth. Thus, increasing the height of the insulating block 25, 95 can improve the performance of the antenna of the present invention at the upper and lower ends of the pass band.

Figure 12:
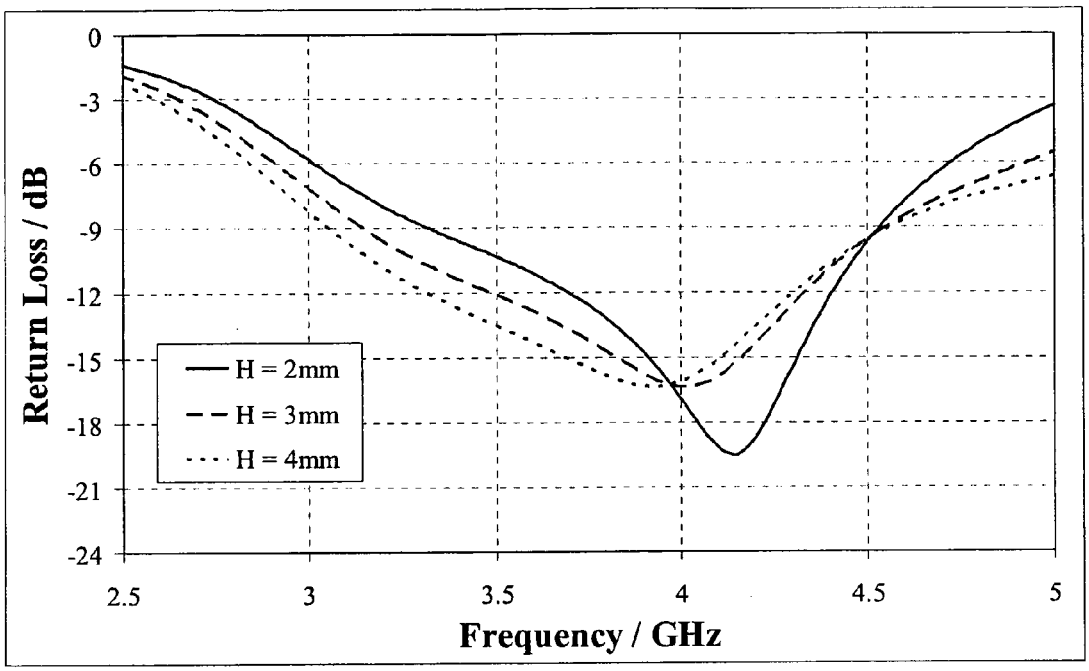
FIG. 12 shows respective plots on the same graph of return loss versus frequency for various heights of the insulating block of the antenna of FIG. 9A.

The plots of FIG. 12 demonstrate the beneficial effects of increasing the height of the insulating block 25, 95 on the return loss (dB). The trade-off for increasing the height of the insulating block is that the overall size of the antenna is now bigger.

Increasing the width of the feed connecting strip 23, 93 of the antenna of the first or second embodiment of the present invention reduces the inductive loading effect at the antenna feed point.

Figure 13:
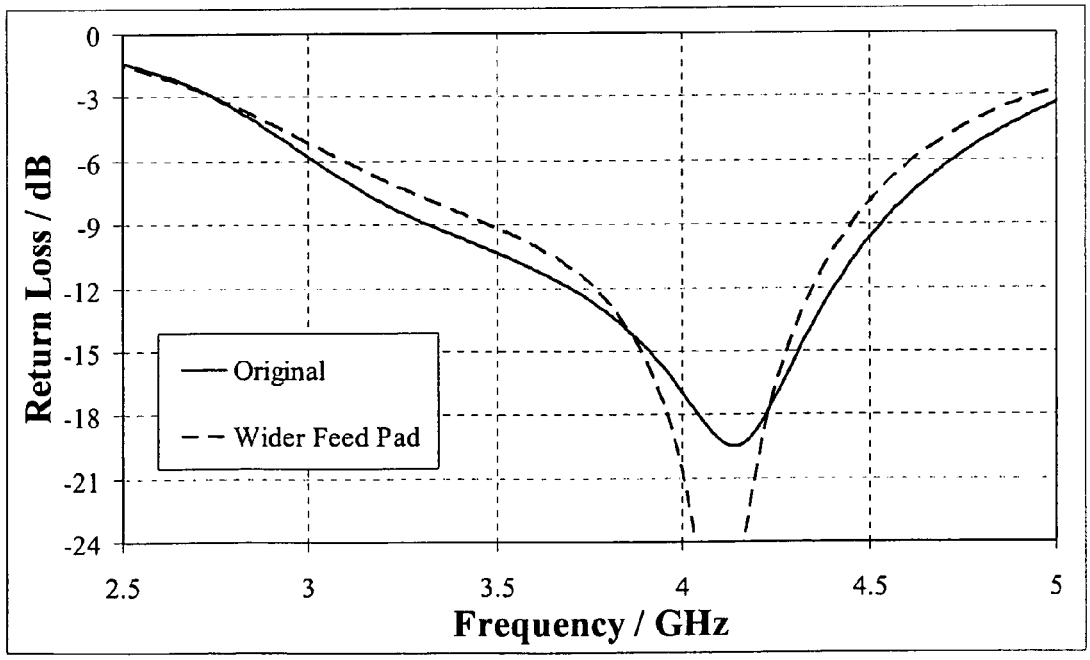
FIG. 13 shows respective plots of return loss versus frequency to illustrate the effect of changing the width of the feed connecting strip of the antenna of FIG. 9A.

FIG. 13 shows a plot of return loss (dB) versus frequency (GHz) resulting from a computer generated electromagnetic simulation of the antenna of FIG. 9A where the feed connecting strip 93 is 0.8 mm wide overlaid with a similar plot where the width of the feed connecting strip is 1.5 mm. It can be seen that widening the feed connecting strip provides a sharper resonance with the downside that the bandwidth of the antenna is reduced at both the top and bottom ends.

Third Embodiment

Figure 14:
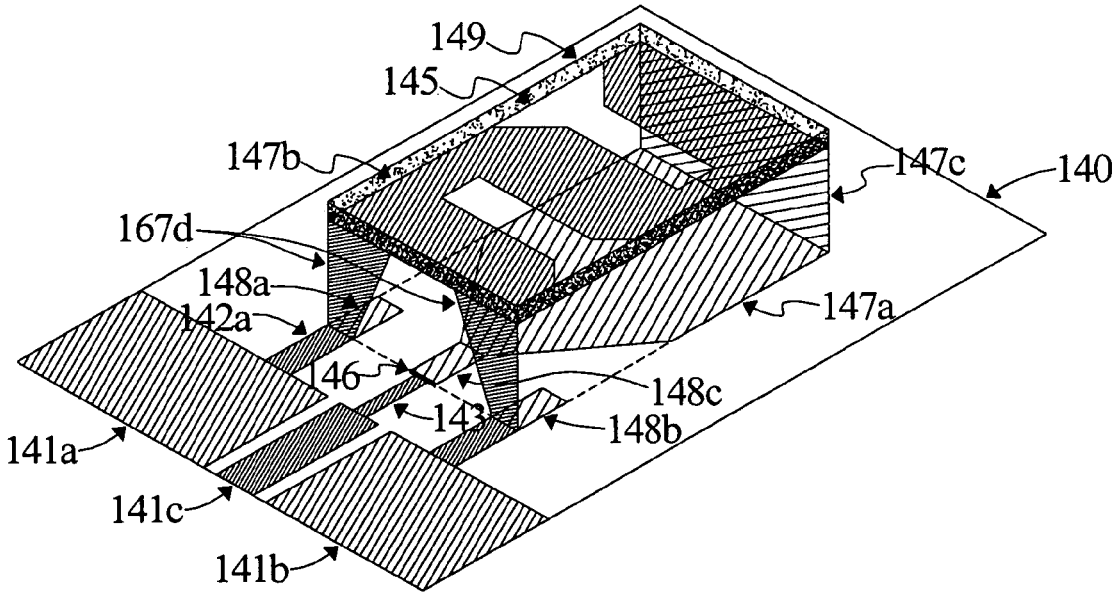
FIG. 14 shows a third embodiment of the folded slotted monopole antenna of the present invention which includes first and second insulating blocks stacked on top of each other.

FIG. 14 shows a folded slotted monopole antenna according to a third embodiment of the present invention. The embodiment of the present invention depicted in FIG. 14 includes all of the features of the antenna of FIG. 2A. For clarity the features of the antenna of FIG. 14 have been labeled using numerals which correspond to those of FIG. 2A, except that the numbers are incremented by 120.

The antenna of FIG. 14 comprises a first insulating block 145, where the material of the block has a dielectric constant greater than unity. The insulating block is mounted on a carrier substrate 140. The carrier substrate includes a metallic feed-line 141*c* and ground planes 141*a*, and 141*b* formed on an obverse surface thereof. The insulating block 145 is mounted on the carrier substrate 140 so that a first end thereof is nearest the feed-line 141*c*. The insulating block 145 comprises lower and upper horizontal faces which are substantially parallel to the carrier substrate, and four vertical faces which are substantially perpendicular to the carrier substrate.

A feed point 146 is located near the first end of the insulating block 145. The feed point 146 passes RF signals (including microwave signals) from a transceiver device (not shown) to the antenna and similarly passes RF signals (including microwave signals) received by the antenna to a transceiver device.

The antenna of FIG. 14 further comprises a metallic lamina which is folded around four of the faces of the insulating block 145. The folded metallic lamina comprises a first planar metallic section 147*a*, which is printed on the lower horizontal face of the insulating block (adjacent to the carrier substrate), a second planar metallic section 147*b* which is printed on the upper horizontal face of the block (opposite the carrier substrate), a third planar metallic section 147*c* which electrically connects the first and second planar metallic sections and which is printed on the vertical face of the block opposite the first end of the insulating block 145, and a fourth planar metallic section 147*d*, which is printed on the vertical face at the first end of the insulating block.

The fourth planar metallic section 147*d* comprises a pair of metallic strips which connect the second planar metallic section to respective ground terminals 148*a*, 148*b* which are formed on the lower horizontal face of the insulating block 145. A corresponding pair of ground pads are formed on the obverse face of the carrier substrate (not shown) and lie in register with the ground terminals 148*a*, 148*b* printed on the lower horizontal face of the insulating block 145. The pair of metallic strips are tapered so that they are narrower where they connect to the ground terminals 148*a*, 148*b* and are wider where they connect to the second planar metallic section 147*b*.

The ground pads are respectively connected to the ground planes 141*a*, 141*b* via two ground connecting strips 142*a*, 142*b* also formed on the obverse surface of the carrier substrate.

A feed terminal 148*c* is formed on the lower face of the insulating block and lies in register with a corresponding feed pad which is formed on the obverse face of the carrier substrate (not shown).

The feed terminal 148*c*, is connected to the first planar metallic section 147*a*, and passes signals from the feed point 146 to the antenna, and vice versa.

The feed pad is connected to the feed line 141*c* via a feed connecting strip 143 formed on the obverse surface of the carrier substrate.

The first planar metallic section 147*a* of the folded metallic lamina of FIG. 14 tapers out from the feed terminal 148*c* and increases in width so that it has the same width as the insulating block 145 approximately midway between the feed point 146 and the third planar metallic section 147*c*.

The second planar metallic section 147*b* can be described as comprising a rectangular metallic pattern which covers the upper face of the insulating block, and which further comprises at least two slots which cut into the rectangular pattern, where the slots are cut from the two sides of the rectangle which are perpendicular to the first end of the insulating block 145 and where successive slots are cut from opposite sides of the rectangular metallic pattern.

A second insulating block 149 is placed on top of the second planar metallic section 147*b* which has the same dimensions in the horizontal plane as insulating block 145. The material of insulating block 149 has a dielectric constant greater than unity. Adding a second insulating block 149 concentrates the electric and magnetic fields around the antenna into the volume occupied by the dielectric material. This has the effect of further increasing the effective resonant length of the antenna and thus reducing the frequency of the fundamental resonance. The amount by which the frequency is reduced depends on the dielectric constant of the material of the insulating block 149 and the height thereof. This dielectric loading allows for additional control over the position of the fundamental resonance of the antenna and is particularly useful for fine tuning the antenna. This may prove useful for example, if the antenna operation was de-tuned by the close proximity of other mounted components.

Figure 15:
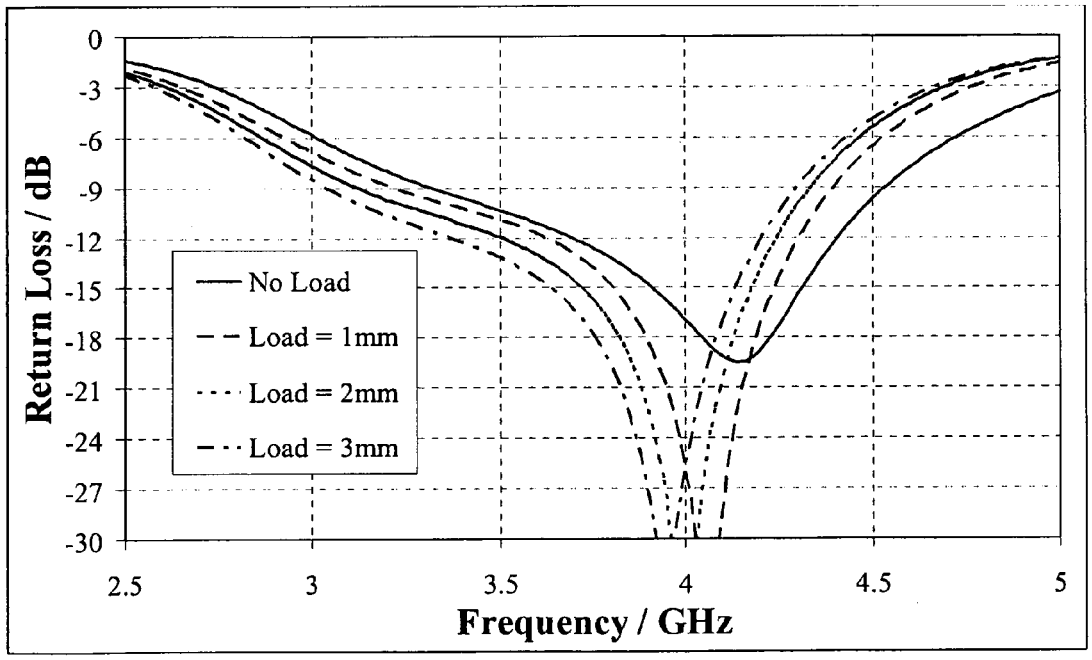
FIG. 15 shows a comparison of return loss plots for various heights of the second insulating block of the embodiment of the present invention depicted in FIG. 14.

FIG. 15 shows a comparison of return loss (dB) vs. frequency (GHz) for various heights of the second insulating block 149 of the antenna of the present invention depicted in FIG. 14. As can be seen from the plots, increasing the height of the second insulating block has the effect of loading or pulling down the frequency of the main resonance of the antenna. This has the positive effect of improving the performance at the low end of the operating band of the antenna, but degrades the performance at the upper end. Nonetheless if optimum performance at the lower end of the operating band of the antenna is required at the expense of performance at the upper end of the pass band then the loading effect of the second insulating block 149 could prove to be very useful.

The invention claimed is:

1. An antenna comprising:

an electrically insulating carrier substrate having a first surface and a second surface;

a first ground plane partially covering at least one of said first or second surfaces of said carrier substrate;

an electrically insulating block mounted on said first surface of said carrier substrate so that a first end of said electrically insulating block is located near said first ground plane, said electrically insulating block having a first face facing said first surface of said carrier substrate, and an opposite second face facing away from said first surface of said carrier substrate;

a feed line provided on one of said first or second surfaces of said carrier substrate;

a feed point located near said first end of said electrically insulating block;

a first electrically conductive lamina section located on said first face of said electrically insulating block; and a second electrically conductive lamina section located on said second face of said electrically insulating block, wherein said first and second lamina sections are electrically connected together at a second end of said electrically insulating block, said second end being substantially opposite said first end of said electrically insulating block, said second lamina section is shaped to define at least two slots, said at least two slots extending from opposite sides of said second electrically conductive lamina section and being interleaved so as to define a non-linear current path in said second lamina section between said first and second ends of said electrically insulating block, an end of said second lamina section that is adjacent to said first end of said electrically insulating block is electrically connected to said first ground plane, a second ground plane provided on one of said first and second surfaces of said carrier substrate, said second ground plane extending adjacent to and spaced apart from a side of said electrically insulating block, said second ground plane protruding from, and being electrically connected to, said first ground plane, and said first ground plane is divided into first and second sections located on opposite sides of said feed line, said second ground plane extending from said second section of said first ground plane, and wherein an electrically conductive connector electrically connects said second lamina section to said second section of said first ground plane.

2. The antenna as claimed in claim 1, wherein said first and second lamina sections each form a respective part of an electrically conductive lamina that is folded around said electrically insulating block.

3. The antenna as claimed in claim 2, wherein said electrically insulating block includes a third face, said third face being adjacent to said second end of said electrically insulating block, said folded lamina further comprising a corresponding third electrically conductive section that is located on said third face of said electrically insulating block.

4. The antenna as claimed in claim 3, wherein said third lamina section electrically connects said first and said second lamina sections.

5. The antenna as claimed in claim 1, wherein said electrically insulating block comprises a fourth face, said fourth face being adjacent said first end of said electrically insulating block, said folded lamina further comprising a corresponding fourth electrically conductive lamina section that is located on said fourth face of said electrically insulating block.

6. The antenna as claimed in claim 5, wherein said fourth lamina section comprises at least one ground connecting strip electrically connecting said second lamina section to said first ground plane.

7. The antenna as claimed in claim 6, wherein said at least one ground connecting strip narrows in a direction from said second lamina section to said first ground plane.

8. The antenna as claimed in claim 1, wherein said at least two slots are formed from sides of said second lamina section which are not in direct electrical contact with any other electrically conductive section of said antenna.

9. The antenna as claimed in claim 1, wherein said electrically insulating block is formed from a material that has a dielectric constant greater than unity.

10. The antenna as claimed in claim 1, wherein said feed line and said first ground plane are configured to provide a waveguide feed structure.

11. The antenna as claimed in claim 10, wherein said first ground plane is divided into first and second sections provided on said first surface of said carrier substrate and on opposite sides of said feed line providing a coplanar waveguide feed structure.

12. The antenna as claimed in claim 1, wherein said second lamina section is not connected to said first section of said first ground plane.

13. The antenna as claimed in claim 1, wherein said second ground plane is spaced apart from said side of said electrically insulating block by a distance W, said distance W being selected to optimize the radiating efficiency of said antenna.

14. The antenna as claimed in claim 1, wherein said second ground plane is spaced apart from said side of said electrically insulating block by a distance W, said distance W being selected to optimize the effect that said distance W has on an input match and a bandwidth of operation of said antenna.

15. The antenna as claimed in claim 1, wherein a portion of said second ground plane is located sufficiently close to a portion of said first dr second lamina sections that, in use, carries electrical current that is large enough to induce electrical current to flow in said portion of said second ground plane.

16. The antenna as claimed in claim 15, wherein said portion of said second ground plane is located sufficiently close to a portion of said first lamina section that, in use, carries electrical current that is large enough to induce electrical current to flow in said portion of said second ground plane, said second ground plane being substantially coplanar with said first lamina section.

17. The antenna as claimed in claim 1, wherein a portion of said second ground plane runs substantially parallel with a portion of said first or second lamina sections located substantially at said side of said electrically insulating block.

18. The antenna as claimed in claim 1, wherein each of said at least two slots has a mouth, at least part of at least one of said at least two slots narrowing in a direction inwardly of said mouth.

19. The antenna as claimed in claim 1, wherein a second insulating block is stacked on top of said electrically insulating block, said second insulating block providing dielectric loading of said antenna.

* * * * *